United States Patent [19]

Hartman

[11] Patent Number: 4,474,296

[45] Date of Patent: Oct. 2, 1984

[54] PORTABLE ARCHERY STAND

[76] Inventor: Thomas B. Hartman, 9921 #D1 U.S. Highway 34, Grand Lake, Colo. 80447

[21] Appl. No.: 433,663

[22] Filed: Oct. 12, 1982

[51] Int. Cl.[3] ..... A47F 7/00

[52] U.S. Cl. ..... 211/13; 124/23 R; 248/122

[58] Field of Search ..... 211/13, 60 R, 62, 60 M, 211/69.4; 124/23 R; 248/121, 122, 127, 441 R

[56] References Cited

U.S. PATENT DOCUMENTS

| | | | |
|---|---|---|---|
| D. 135,982 | 7/1943 | Morris | 211/13 X |
| 2,464,031 | 3/1949 | Fiedel | 211/13 X |
| 3,286,961 | 11/1966 | Mandolare | 248/122 X |
| 3,584,820 | 6/1971 | Butcher | 248/122 |
| 3,952,878 | 4/1976 | Gorham | 248/161 X |

*Primary Examiner*—Ramon S. Britts
*Assistant Examiner*—Sarah A. Lechok
*Attorney, Agent, or Firm*—Leonard S. Michelman

[57] ABSTRACT

This invention is concerned with a portable stand having a base upon which there are brackets for supporting a bow and a storage facility for housing and storing the arrows.

The bow support comprises of a U-shaped member mounted on a flat base, a vertical member extending upward from the base at a predetermined distance from the U-shaped member having a pair of parallel protruding horizontal arms forming an elongated opening whereby the middle portion of the bow at its handle can be secured by a bolt and nut to the vertical member within the parallel horizontal arms, and whereby the entire assembly can be carried by holding onto the bow.

There is also a cylindrical opening within a storage compartment that is formed as part of the vertical member whereby the arrows for use with the bow are stored.

There is also provided an accessory compartment which surrounds the opposite side of the vertical member, acting not only as a storage facility for miscellaneous items such as wax and oil, but also as a support for the vertical member.

1 Claim, 4 Drawing Figures

PORTABLE ARCHERY STAND

This invention is concerned with a portable archery stand whereby an archer, a person who uses a bow and arrow for target practice and sport, can carry with him a storage stand upon which he can set his bow and also upon which he can store his arrows.

Many attempts have been made to provide a means to carry a bow with the arrows, and in almost every instance there is great inconvenience and storage difficulties.

It is the primary purpose of the within invention to provide a portable storage stand which will not only protect the bow and arrows from damage, but will also make it convenient to store the arrows therein.

It is yet another object of the within invention to provide a portable stand for carrying a bow and arrows that is light in weight and simple to use.

It is yet a further object of the within invention to provide a portable stand for bow and arrows which is inexpensive in the cost of manufacture.

It is yet an additional object of the within invention to provide a portable stand for a bow and arrows that is conveniently carried and easily managed.

It is still a further object of the invention to provide a sturdy and light weight portable stand and storage facility for a bow and arrows.

These and other objects may be more readily understood by reference to the following detailed description and specification in which the drawings are:

The portable stand 1 comprises various segments. Stand 1 has a flat base 1*a*. Mounted on the flat base 1*a* is the U-shaped accessory holder and support 1*d*. This support not only strengthens the vertical member 1*e*, but also provides a compartment for storage of wax, oil and other miscellaneous items.

The cylindrical arrow quiver 1*c* is integral with the vertical support arms 1*b* and 1*e*. There is a slot 1*f* formed between the bifurcated vertical arms 1*b* and 1*e*.

Figure 1:
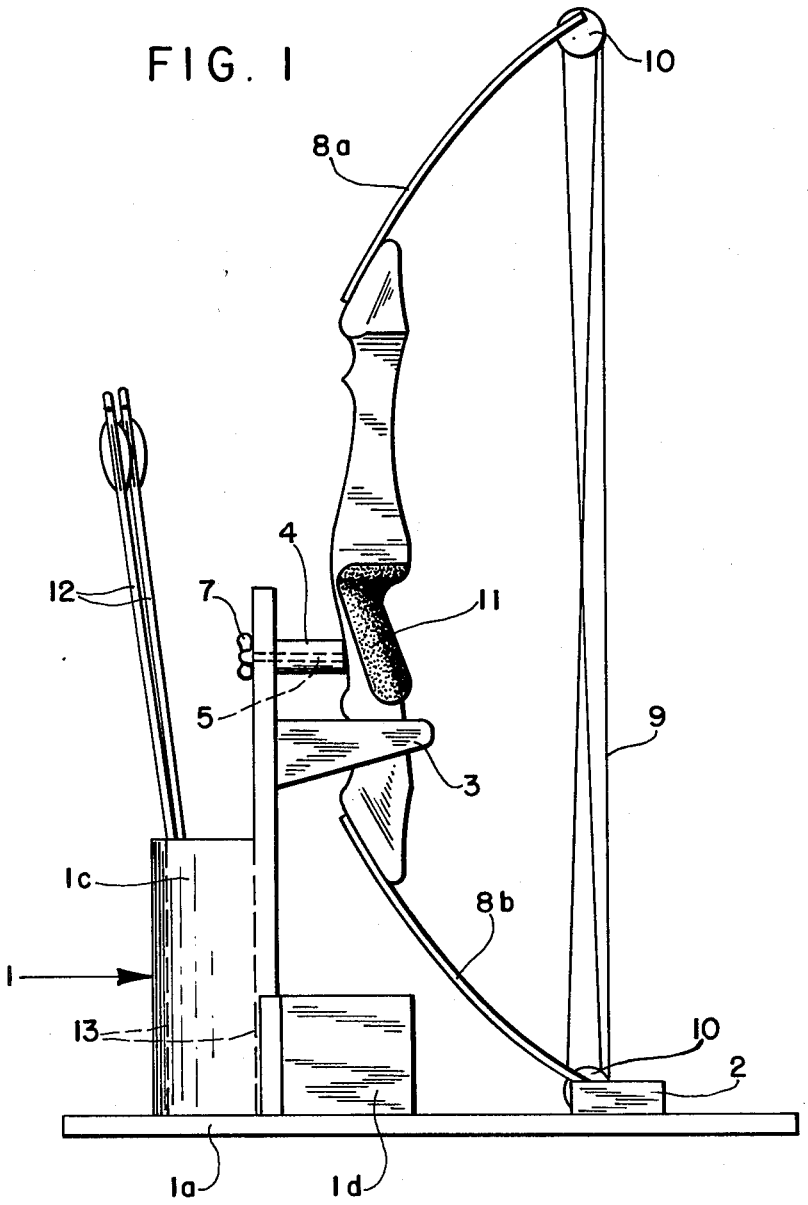
FIG. 1 is a side elevational view of the portable stand with a bow and arrows positioned therein.
Figure 2:
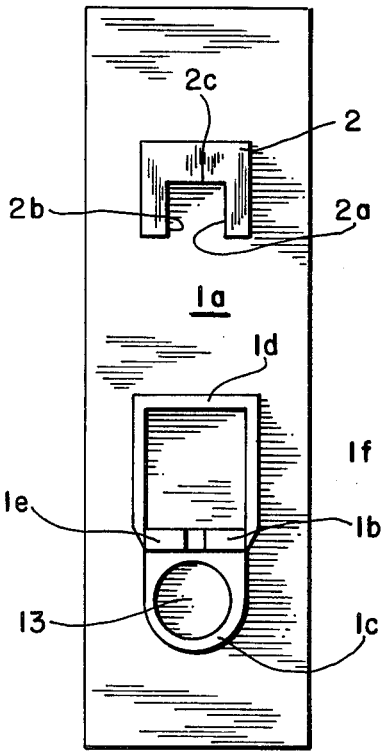
FIG. 2 is a top elevational view looking down on the view of FIG. 1, without the bow and arrows in position (and without the arms 3 showing).
Figure 3:
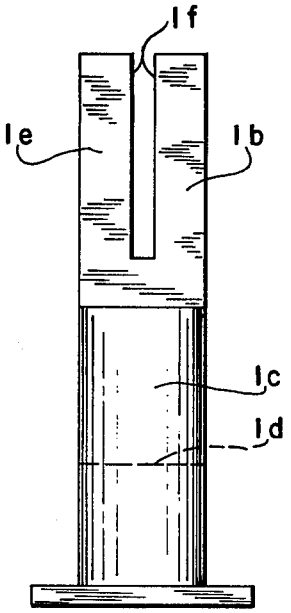
FIG. 3 is an elevational view looking at the end of the view of FIG. 1 from the left, without the bow and arrows in position.
Figure 4:
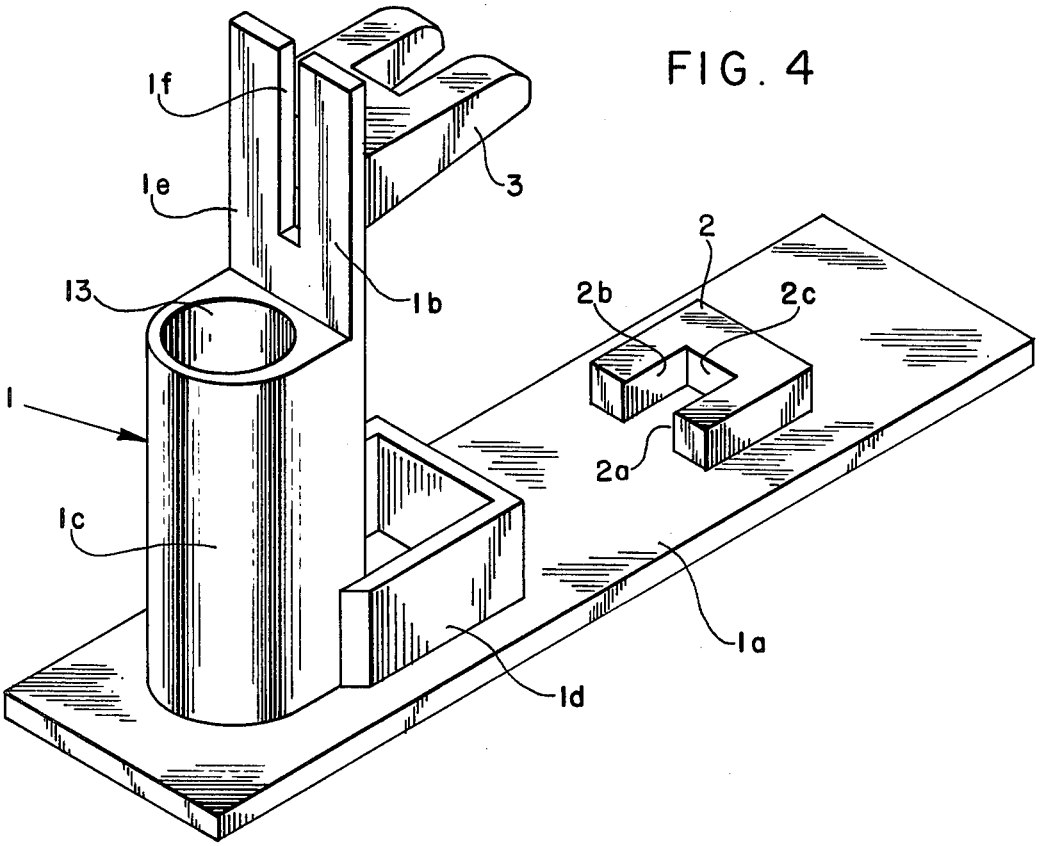
FIG. 4 is a perspective view of FIG. 1, without the bow and arrows in position.

Bow arms 3 extend outwardly and horizontally from the bifurcated vertical arms 1*b* and 1*e* as can be seen in the views of FIGS. 1 and 4. Bow arms 3 are parallel to each other and form an opening therebetween.

The arrow quiver member 1*c* is cylindrical (it could be square or eliptical) and has an opening 13 in which the arrows 12 are stored is observed in the view of FIG. 1.

There is a U-shaped support bracket 2 for securing the bottom segment 8*b* of the bow which bracket 2 comprises the segments 2*b*, 2*c* and 2*a*. Reference is made to the view of FIG. 4.

It is within the spirit and scope of this invention to change the location of the support bracket 2 to complement the size of the bow being supported and accordingly it is within the spirit and scope of this invention to raise or lower the parallel arms 3.

The parallel arms 3, which act as the upper guide and support braces for securing the upper segment 8*a* of the bow, are parallel and extend outwardly from the bifurcated arms 1*b* and 1*e*. There is a spacer 4 located between the handle 11 and the slot 1*f*, and within the spacer 4 is a stud bolt 5 upon which there is threaded a wing-nut 7.

The bow, which can be seen in the view of FIG. 1, comprises of the upper bow segment 8*a* and the lower bow segment 8*b*, the handle 11 located therebetween and the bow string 9 which, in the embodiment shown, is mounted on the pulleys 10 at the upper and lower segments. The pulleys 10, with the advance of the art and technology of archery, are in common use by most archery enthusiasts instead of the simple tension string. The handle 11 of the bow comprises the center piece of the bow 8*a* and 8*b*.

In operation the bow is placed so that its lower segment 8*b* fits within the enclosed area of the U-shaped support bracket 2 bounded by 2*a*, 2*b*, and 2*c*. The center piece 11 between the upper bow segment 8*a* and the lower bow segment 8*b* is located in the opening between the upper support arms 3. A bolt 5 is inserted within the spacer 4 and attached to a wing-nut 7, passing through an opening in the handle 11. The wing-nut 7 is larger than the slot 1*f*. See the view of FIG. 1.

Upon securing the wing-nut 7 to the bolt 5, the bow is locked into position in the portable stand 1. The portable stand 1 can be carried by picking up the bow by its handle 11. It can be set down on the flat base 1*a* as shown in FIG. 1.

The location of the spacer 4 assembly is not crucial. Depending upon the size of the bow, the spacer 4 assembly can be lowered or raised in the slots between the bifurcated arms 1*b* and 1*e*.

The arrows 12 are placed in the opening 13 of the arrow quiver 1*c*. The portable stand 1 is designed to be carried in an upright position. The bow will therefore stay in place, and of course, will always be secured to the portable stand 1 so long as it is held together by the bolt 5 and the wing-nut 7 through the spacer 4. When the bow is to be used, the wing-nut 7 is unthreaded and the bolt 5 is removed from the spacer 4.

It is contemplated that the shapes of the stand can be changed from square to circular or rectangular without departing from the spirit and scope of the invention.

The within invention has solved the problem of storing and carrying the bow and arrows whenever they are not in use, to keep the bow together with the arrows, and as a convenience for protecting the bow and arrows from loss and physical damage.

It is within the spirit and scope of this invention to provide the stand with a cover to protect the bow and arrows from the elements.

In consideration of the foregoing, I claim:

1. A portable archery stand for supporting a bow, having an upper segment, a middle portion, including a handle, a lower segment and a plurality of arrows, comprising a base having a flat upper surface, a U-shaped support bracket mounted on the upper surface of said base, a vertical member extending upwardly from the said upper surface of said base located a predetermined distance from said U-shaped member, means at the top of said vertical member forming bifurcated arms, horizontal parallel arms mounted on said vertical member for supporting the middle portion of the bow, means for securing the middle portion of said bow to said bifurcated arms, a facility for storing said arrows mounted on said base contiguous with said vertical member, a U-shaped accessory compartment for supporting said vertical member and providing a storage facility for miscellaneous items, each of said parallel arms extending outwardly and horizontally from the vertical member and on the opposite side from the arrow storage facility so as to surround and act as a support for the handle portion of the bow, a spacer, said spacer located between the handle of the bow and the slot opening between the bifurcated arms, and a bolt adapted to pass between an opening in the bow handle and within the spacer, a wing-nut whereby when said wing-nut is threaded to the bolt, the bow is secured at its lower segment next to the U-shaped bracket and at the bow handle by the parallel horizontal arms in an upright position, so that the bow cannot move.

* * * * *